US005799469A

United States Patent [19]

Obrist

[11] Patent Number: 5,799,469

[45] Date of Patent: Sep. 1, 1998

[54] METHOD FOR THE MANUFACTURE AND/OR FILLING OF A TWO-CHAMBER PRESSURE PACK

[75] Inventor: Gerhard Obrist, Kaiseraugst, Switzerland

[73] Assignee: Lechner GmbH, Rielasingen/Worblingen, Germany

[21] Appl. No.: 641,280

[22] Filed: Apr. 30, 1996

[51] Int. Cl.[6] ..... B65B 7/00

[52] U.S. Cl. ..... 53/470; 53/432; 53/408

[58] Field of Search ..... 53/432, 449, 403, 53/408, 470, 280

[56] References Cited

U.S. PATENT DOCUMENTS

| | | | |
|---|---|---|---|
| 4,350,272 | 9/1982 | Petterson | 53/403 |
| 5,505,039 | 4/1996 | Maier | 53/432 |
| 5,623,975 | 4/1997 | Simson | 53/403 |

*Primary Examiner*—Linda Johnson
*Assistant Examiner*—John Paradiso
*Attorney, Agent, or Firm*—Bachman & LaPointe, P.C.

[57] ABSTRACT

In a method for the manufacture and/or filling of a two-chamber pressure pack comprising an outer container having a can wall, a bottom and a valve opening and of a bag having a bag bottom in the outer container for receiving a product, the outer container and bag enclose a space for receiving a gas. The space between outer container and bag is in this case filled with the gas prior to filling the bag with the product.

9 Claims, 3 Drawing Sheets

METHOD FOR THE MANUFACTURE AND/OR FILLING OF A TWO-CHAMBER PRESSURE PACK

BACKGROUND OF THE INVENTION

The present invention relates to a method for the manufacture and/or filling of a two-chamber pressure pack consisting of an outer container having a can wall, a bottom and a valve opening and of a bag having a bag bottom within the outer container for receiving a product, the outer container and the bag enclosing a space for receiving a gas.

Methods for the manufacture of such a two-chamber pressure pack are known in various forms and embodiments. It is in this connection an essential feature of the two-chamber pressure pack that, upon the dispensing of the product, the inner bag is compressed by the internal pressure in the space between inner bag and outer container and the product is pressed out in this manner. Accordingly, no propellant gas or the like need be used in the product for the dispensing of the product.

It is known in the case of at least one method for the bag to line the interior space of the outer container to the extent of almost 100 percent, as is the case in particular for bags which are injection molded into the outer container. The bag is then filled with a product in which connection said product may however fill the inner bag to the extent of only about 60% so that sufficient space is available for a pressure gas between inner bag and outer container. This means that the gas must be removed from the area of the inner bag which is without product, and this takes place upon action on the space between inner bag and outer container. Pressure gas is introduced in this connection into said space until the product spurts out of the valve device placed on. This is not only extremely untidy, but it also results in a loss of product and leads at regular intervals to machine malfunctions. After this, extensive cleaning work must be carried out. It is the object of the present invention to create a method of the above-mentioned type which eliminates said disadvantages and assures absolutely clean dispensing combined with a high degree of accuracy of the product filled in.

SUMMARY OF THE INVENTION

The foregoing object is achieved by way of the present invention in that the space between outer container and bag is filled with the gas prior to filling the bag with the product.

There is thus concerned a pre-gassed system in which the space between inner bag and outer container is already under pressure when the product is being introduced. Due to the introduction of the product, the pressure in the space between inner bag and outer container is increased to a desired value in which connection said value need never be as precise as the product volume had to be in the case of the previous methods. It is therefore sufficient for an absolutely precise quantity of a product volume to be introduced into the inner bag. The pressure in the space between inner bag and outer container need have only an approximate value. As a result, a degassing of the interior space of the inner bag is no longer necessary, so that the disadvantages which result upon the squirting out of the product are no longer present. This is a very essential advantage of the new manufacturing and filling method.

Due to the action of pressure on the space between inner bag and outer container prior to the introduction of the product, the bottom of the bag is to be preferably brought into the region of the valve opening. This assures that the inner bag is turned inside out in a substantially uniform manner so that the wall of the bag is applied against itself in two layers in the tightest manner possible. In this way, air inclusions are avoided which in turn could lead to an impairment of the product, for instance due to oxidation or the like.

In accordance with one simple embodiment of the invention, said turning inside out of the inner bag takes place by the introduction of the gas into the space between inner bag and outer container. This would of course be the ideal solution since additional work steps would thereby be avoided. It would, in this case, be sufficient for the valve opening to be already closed off by the valve device and the desired pressure being built up in the space between inner bag and outer container. Said pressure is in that case so high that the inner bag snugly applies itself to the greatest possible extent against the contour of the valve device, and any air present between valve device and inner bag is thereby expelled.

To be sure, experience has shown in this case that there is no turning inside out of the inner bag since the inner bag detaches itself in non-uniform manner from the outer container. As a result, the inner bag is not applied against itself in two uniform layers, but there result air inclusions in the inner bag which cannot be expelled through the valve device. This is a disadvantage.

Another possibility consists in applying a vacuum through the valve opening so that the bottom is pulled towards the valve opening. Also in this case the danger is not entirely avoided that the inner bag will be turned inside out in non-uniform manner or will be compressed prematurely. Furthermore, in this case the valve device must be placed on after the vacuum and the space between inner bag and outer container a vacuum must be applied in addition via the valve (sic). This is an additional process step.

In the case of a third possibility, a mechanical method is contemplated for bringing the bottom of the bag into the vicinity of the valve opening. For this purpose, a ram is inserted into the inner bag which ram has suction cups or is itself developed as a suction cup. Said ram accordingly has a bore hole for the application of a vacuum so that the bottom of the bag can be attracted by the ram. Upon its removal, the ram then carries the bottom of the bag along and releases it in the region of the valve opening. This best assures a smooth turning inside out of the inner bag.

After removal of the ram from the valve opening, the valve device is placed on the valve opening and the inner bag is filled through the valve device. In accordance with the invention, a drawing off of residual air from the inner bag through the valve device can also be effected at this stage. This process step is furthermore possible and conceivable in the case of all above-mentioned variants. In this way, the inner bag is kept completely free of air, there being furthermore produced a certain vacuum so that the introduction of a product can be accelerated.

The fourth possibility consists of another mechanical method for moving the bottom of the bag towards the bag opening. In this case a ram is introduced through the bottom hole of the outer container and the bottom of the bag is pushed in the direction towards the opening.

After removal of the ram from the bottom hole, the valve opening is closed off by the valve device and the residual air of the inner bag is drawn off by vacuum. The inner bag applies itself in this case against the outer container in defined manner and turned inside out.

The inner bag is produced in such a manner that the ram, upon its introduction into the bottom hole of the outer container, cannot destroy the bottom of the bag.

There has already been produced in preferred manner a two-chamber pressure pack for a customer wherein all process steps have been carried out at the manufacturer's except for the filling of the inner bag with the product. There is no danger upon the transportation of the pre-gassed two-chamber pressure packs, since the pressure in the space between inner bag and outer container is not very high and air is furthermore customarily used as pressure gas.

BRIEF DESCRIPTION OF THE DRAWINGS

Further advantages, features and details of the invention result from the following description of preferred embodiments and from the drawing, in which:

FIG. 6 is the longitudinal section through the two-chamber pressure pack according to FIG. 3 with the valve device placed on;

DETAILED DESCRIPTION

Figure 1:
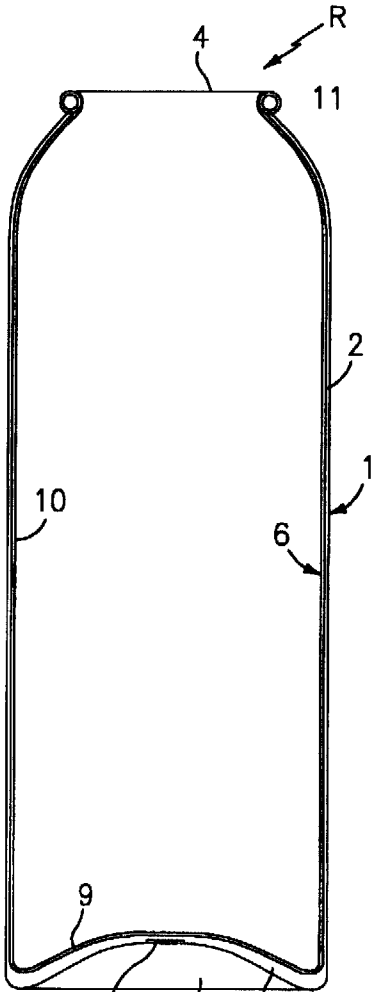
FIG. 1 is a longitudinal section through a two-chamber pressure pack without valve device.

FIG. 1 shows the outer container 1 of a two-chamber pressure pack R which container can consist of any desired material. It is preferred to employ the metal aluminum without the invention however being restricted thereto. How the outer container 1 is being produced is of secondary importance. It has in any event a wall 2 of the can, a bottom 3 and a valve opening 4. In the case of the present embodiment, the bottom 3 is developed arched inward so as to better withstand an internal pressure in the space 5 between an inner bag 6 and the outer container 1. Furthermore, the bottom 3 has a filling opening 7 for a pressure gas.

In the present embodiment the outer container 1 furthermore has an inner coating 8 which, however, is not absolutely necessary. The wall 2 of the can is developed cylindrical in the present embodiment, which is also not absolutely required.

The inner bag 6 consists of a collapsible material such as a plastic material, a metal foil or the like. It can be inserted separately into the outer container 1 or be injection-molded into the outer container 1. Manufacture and insertion of the inner bag 6 are not of essential importance for the invention. All variants fall under the scope of the present invention.

It can be noted that the inner bag 6 has a bag bottom 9 which is adjoined by a bag wall 10 extending up to the valve opening 4. The latter feature is also not required since there are also known two-chamber pressure packs in which the inner bag is glued into the outer container and wherein an upper bag edge is at a distance from the valve opening 4.

In the present case, the valve opening 4 is defined by a beaded edge 11 on which a valve device 12 (see FIGS. 6 and 7) is placed at a later time.

The two-chamber pressure pack is to be manufactured and/or filled in accordance with the following method according to the invention:

One proceeds from the two-chamber pressure pack shown in FIG. 1 which is at the manufacturing stage in which the inner bag 6 is present in the outer container 1 and is at least partially connected, in whatever manner, to the outer container 1. The valve opening 4 can be open or else closed off by a valve device 12. This is of importance only for one variant of the method of the invention.

Figure 3:
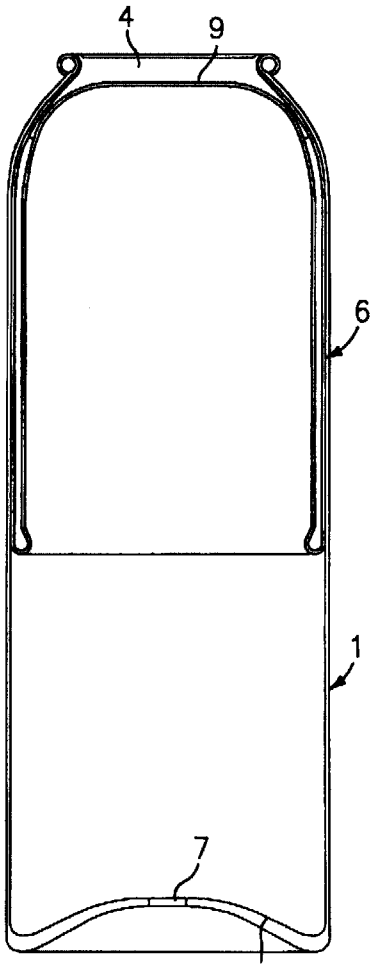
FIG. 3 is the longitudinal section through the two-chamber pressure pack according to FIGS. 1 and 2 at a further manufacturing stage.
Figure 2:
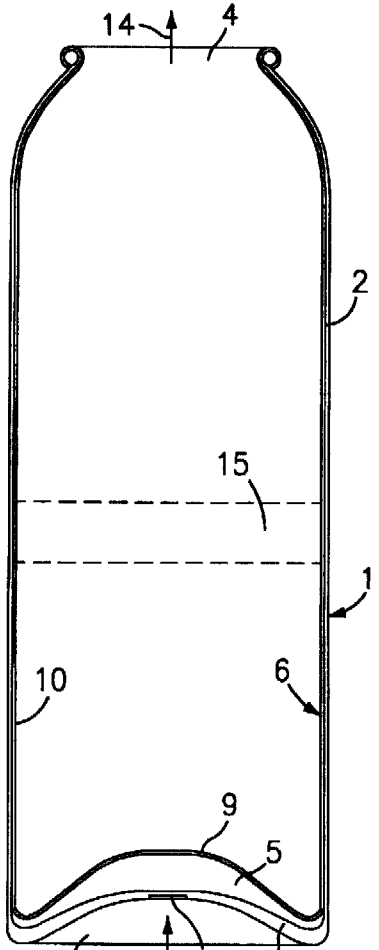
FIG. 2 is the longitudinal section through the two-chamber pressure pack according to FIG. 1 at a further manufacturing stage.

The next step of the method of the invention consists of bringing the bag bottom 9 into the area of the valve opening 4 as shown in FIGS. 2 and 3. In this case, a valve device 12 can, but need not, already be seated on the valve opening 4.

One possibility for this process step consists—as indicated by the arrow 13—in the introduction of gas, in particular air, through the filling opening 7 into the space 5 between inner bag 6 and outer bag 1. The bag bottom 9 then moves away from the bottom 3 of the outer container and travels towards the valve opening 4. If the valve opening 4 has already been closed by the valve device 12, the space 5 can already be filled with the desired gas pressure so that the bag bottom 9 can also apply itself to the greatest possible extent snugly against a contoured inner surface of the valve device 12. In this way, the greatest possible degassing of the interior of the inner body 6 takes place.

To be sure, this variant of the method of the invention could have the disadvantage that the bag wall 10 detaches itself in non-uniform manner from the wall 2 of the can so that the bag bottom 9 does not travel towards the can opening 4, but the inner bag 6 is compressed in some other manner. In this case, however, there is the danger that a relatively large amount of air is trapped in the compressed inner bag 6 which is not desirable. Furthermore, such a two-chamber pressure pack can scarcely be filled properly.

In another embodiment of the invention it is therefore provided—as shown by the arrow 14—that a vacuum is applied in the interior of the inner bag 6 through the valve opening 4 or through a valve device placed on the valve opening 4. In this way a drawing of the bag bottom 9 in the direction towards the valve opening 4 is improved. To be sure, the danger of a non-uniform drawing off of the bag wall 10 from the wall 2 of the can is not completely eliminated.

It is also possible to introduce an adhesive in a central region 15 on the inner surface of the wall 2 of the can, which region is indicated in dashed line, so that a non-uniform detaching of the bag wall 10 from the wall 2 of the can is avoided. The application of such an adhesive area 15 however is difficult and very costly.

Figure 4:
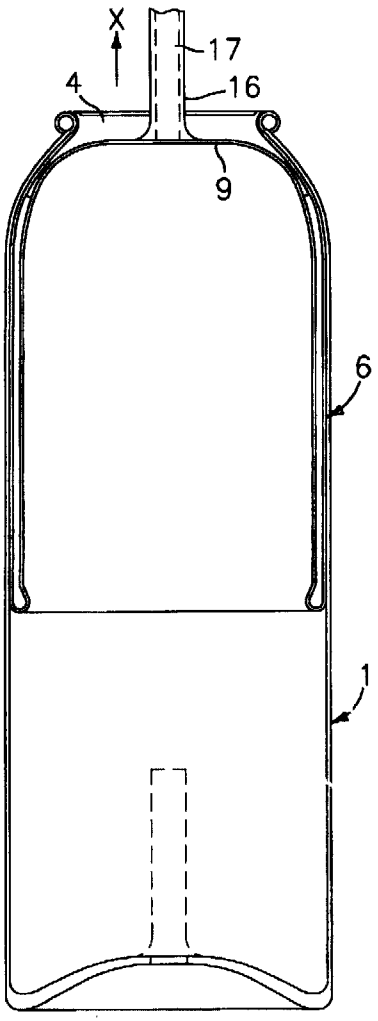
FIG. 4 is the longitudinal section through the two-chamber pressure pack according to FIG. 3 in the case of a different type of manufacture.

A mechanical solution for bringing the bag bottom 9 into the area of the valve opening 4 is also conceivable, as shown in FIG. 4. There is provided for this a ram 16 which has an axial bore hole 17 which is connected to a source of vacuum, not shown in detail. The ram 16 is introduced into the inner bag 6 until it is in the position shown in dashed line. Upon the application of the vacuum, the bag bottom 9 is attracted so that the ram 16 upon its removal in the direction x carries the bag bottom 9 along with it. As soon as the ram 16 is in the region of the valve opening 4, the vacuum is eliminated so that the ram 16 can be removed without the bag bottom 9.

Figure 5:
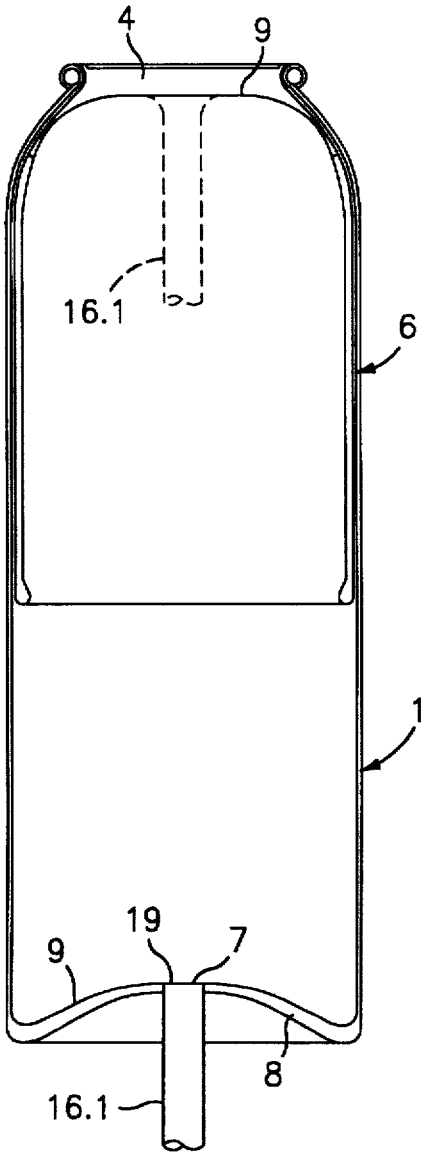
FIG. 5 is a longitudinal section through the two-chamber pressure pack similar to FIG. 4.

Another possibility for mechanically moving the bag bottom 9 into the region of the valve opening 4 is shown in FIG. 5. In this case, a ram 16.1 travels through the filling opening 7 and encounters there the bag bottom 9. The bag bottom 9 is preferably reinforced in this region which can already be effected in the manner that, upon its manufacture, i.e. its injection molding into the outer container 1, the bag bottom 9 is imparted a lens-shaped arching 19.

It is indicated in dashed line that the bag bottom 9 is brought by the ram 16.1 into the vicinity of the valve opening 4. The ram 16 is thereupon pulled out of the outer container 1, a valve is placed on the valve opening 4 and vacuum is applied via the valve so that the remaining space between the bag bottom 9 and the valve is also vented.

Figure 6:
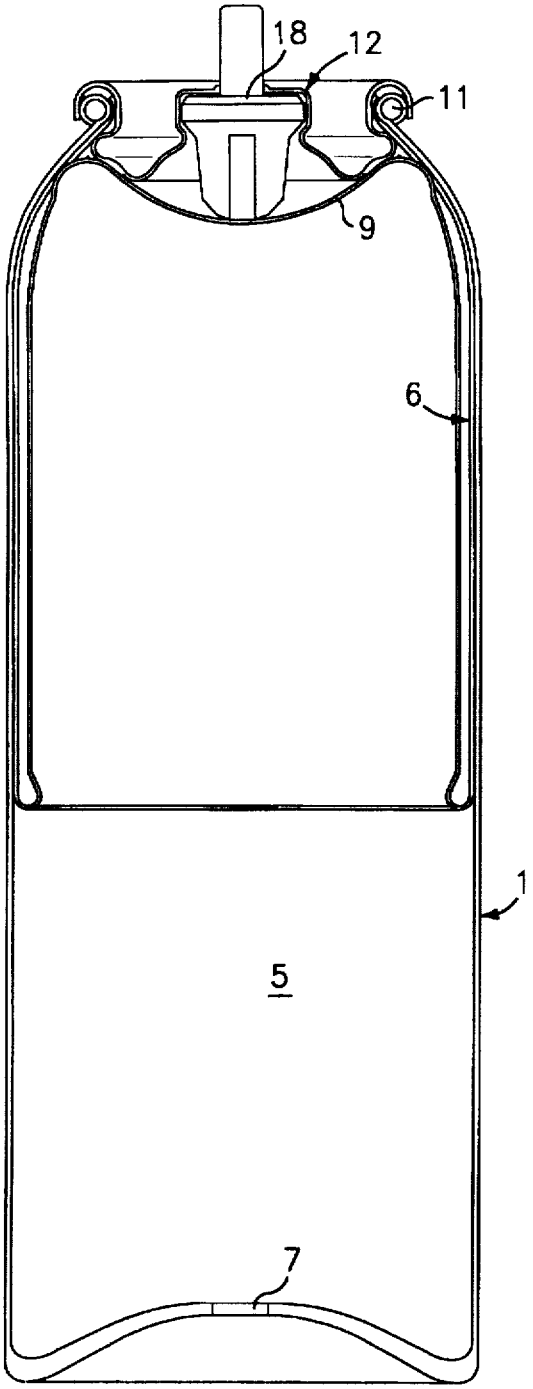

Before the space 5 is now placed under the pressure of a pressure gas through the filling opening 7, the valve opening 4 must be closed off by a valve device 12, as shown in FIG. 6. After placing the valve device 12 on, the space 5 can be filled with pressure gas, in which connection it must be taken into account that the pressure will be increased by a subsequent filling of the inner bag 6 with the product. The corresponding degree of filling can however be determined by simple calculations.

The advantage of the action of pressure on the interior space 5 consists however in the fact that the bag bottom 9 can apply itself to a substantial extent against the inner contour of the valve device 12. As a result thereof, almost the entire air which is still present between the inner bag 6 and the valve device 12 can be expelled through a valve 18. The valve 18 can in this case be provided with additional valve openings which can be arranged at a suitable place for this substantial degassing.

Figure 7:
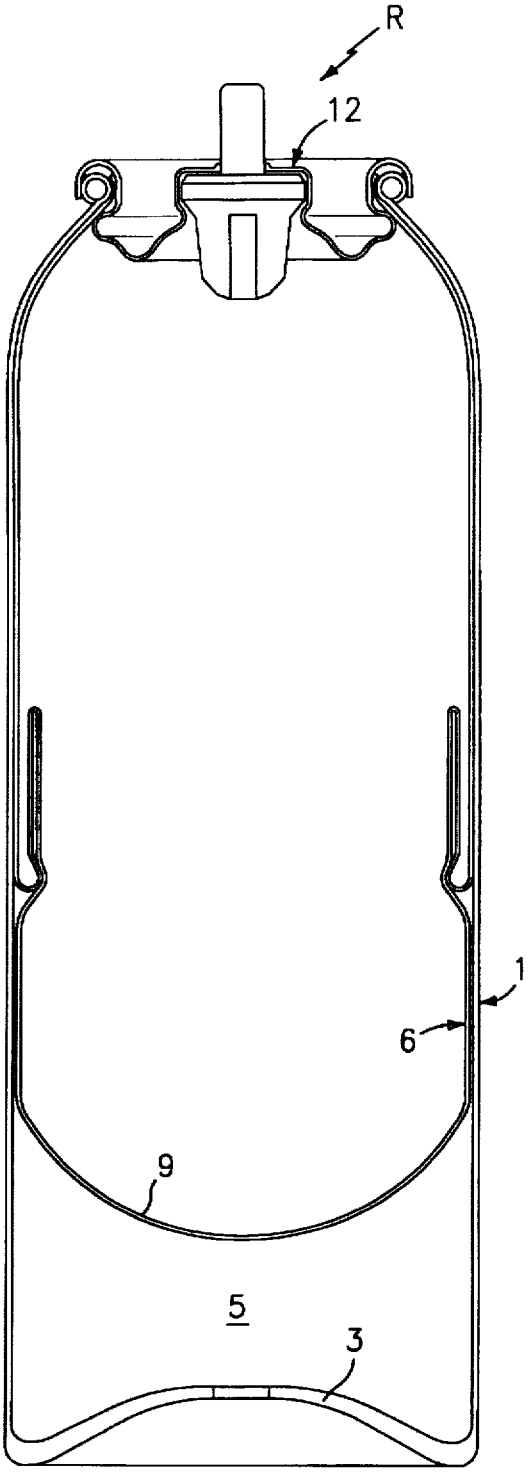
FIG. 7 is the longitudinal section through the two-chamber pressure pack after the introduction of a product.

A precisely defined quantity of product can now be introduced into the two-chamber pressure pack R, as shown in FIG. 7. The introduction takes place through the valve device 12, the bottom 9 then again traveling downward in the direction towards the bottom 3. As a result thereof, the space 5 between inner bag 6 and outer container 1 is reduced and the pressure thus increased. A degassing of the product in the inner bag 6 need no longer take place since there is scarcely present any extraneous air.

I claim:

1. A method for the manufacture and filling of a two chamber pressure pack, comprising the steps of:

providing an outer container having a sidewall and a bottom which together define a first space and a valve opening communicating with said first space;

positioning a bag within said first space;

securing the bag to said sidewall wherein said bag and at least a portion of said bottom of said outer container define a second space;

providing means for feeding gas to said second space; and introducing gas to said second space for biasing a portion of the bag defining said second space toward said valve opening.

2. A method according to claim 1, wherein prior to the introduction of the gas, the portion of the bag is brought into the region of the valve opening.

3. A method according to claim 2, including drawing the portion of the bag toward the valve opening by a vacuum applied at the valve opening.

4. A method according to claim 2, including providing a hole in said bottom and inserting a ram through said bottom hole to bias the bag towards the valve opening.

5. A method according to claim 2, including drawing off residual air from the bag.

6. A method according to claim 4, wherein the bag is reinforced in the region of the hole.

7. A method according to claim 5, including the steps of placing a valve device on the valve opening and drawing residual air off from the bag through the valve device.

8. A method according to claim 1, including the step of introducing product into the bag against the pressure of the gas in second space so that the bag is moved away from the valve opening.

9. A method according to claim 1, characterized by the fact that the inner bag is glued to the wall of the can in an area.

* * * * *